United States Patent [19]

Gamble

[11] Patent Number: 4,464,849

[45] Date of Patent: Aug. 14, 1984

[54] HEATED CAN ROLLS OF HIGH THERMAL EFFICIENCY

[76] Inventor: James E. Gamble, Box 18, Den Rd., Lincoln University, Pa.

[21] Appl. No.: 363,284

[22] Filed: Mar. 29, 1982

Related U.S. Application Data

[63] Continuation-in-part of Ser. No. 335,640, Dec. 30, 1981, , and a continuation-in-part of Ser. No. 178,888, Aug. 18, 1980, Pat. No. 4,321,759, which is a continuation-in-part of Ser. No. 942,942, Sep. 18, 1978, Pat. No. 4,348,819.

[51] Int. Cl.[3] ..... F26B 13/08

[52] U.S. Cl. ..... 34/110; 34/124; 165/89

[58] Field of Search ..... 34/108, 110; 432/10, 432/60, 253, 255.1; 411/373, 374, 104; 162/375, 378, 379, 207; 165/89, 146, 185

[56] References Cited

U.S. PATENT DOCUMENTS 1,640,855 8/1927 Shlick ..... 34/110

4,385,453 5/1983 Withers et al. ..... 34/110

*Primary Examiner*—Larry I. Schwartz

*Attorney, Agent, or Firm*—E. Leigh Hunt

[57] ABSTRACT

Disclosed is an improved heated can roll of high thermal efficiency for web or sheet processing machines, such as a papermaking machine. The improved can roll has means for insulating the ends of the internally heated can rolls to provide a segmental heat insulating part spaced from the roll end or head to provide an air space adjacent to the head or roll ends, resulting in a large reduction in heat loss. Improved means for attaching the insulator assembly to the end faces of the can roll includes use of panel assembly bolts screwed into threaded bores provided within thickened bolt heads of the can roll head bolts.

3 Claims, 14 Drawing Figures

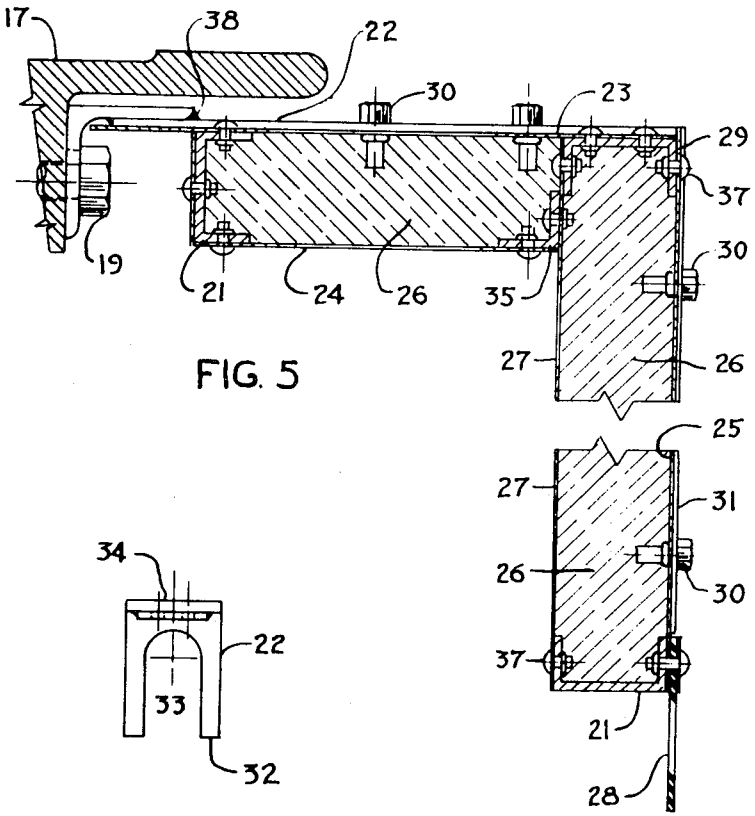
FIG. 5
FIG. 6
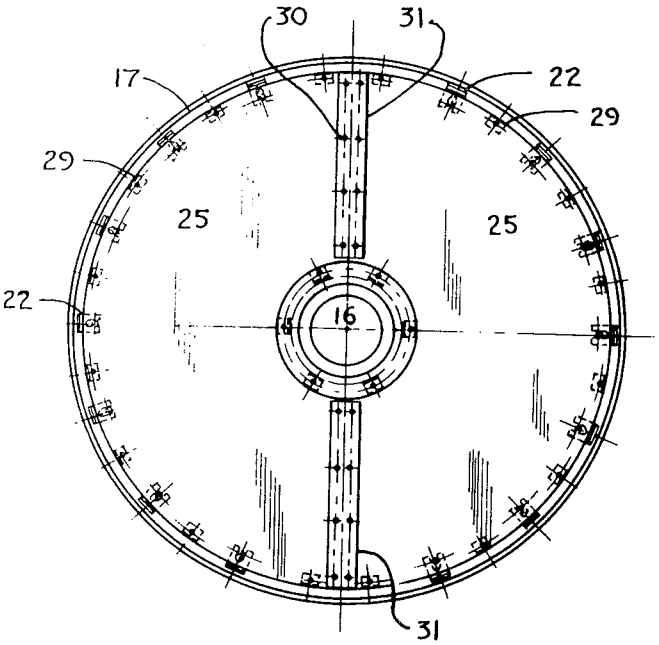
FIG. 4

HEATED CAN ROLLS OF HIGH THERMAL EFFICIENCY

RELATIONSHIP TO OTHER APPLICATIONS

This application is a continuation-in-part application under 35 U.S.C. §120 and 121 of my allowed U.S. application, Ser. No. 178,888, filed Aug. 18, 1980 (which issued Mar. 30, 1982, as U.S. Pat. No. 4,321,759), which was a continuation-in-part application of my application 942,942, filed Sept. 18, 1978 now U.S. Pat. No. 4,348,819. This application is also a continuation-in-part application of my application filed Dec. 30, 1981, entitled "Heated Can Rolls of High Thermal Efficiency," U.S. Ser. No. 335,640.

BACKGROUND OF THE INVENTION

This invention is an improvement in internally steam heated can rolls in a web processing machine, such as a papermaking machine. The invention involves means for reducing heat losses in all forms from the heads, or end enclosures, from the can roll to provide a marked increase in thermal efficiency. The invention is particularly adaptable for modification of existing sheet or web processing machines as all parts can be affixed to the roll by attachment to head bolts that bolt the heads onto the cylindrical shell of the roll, while maintaining the structural integrity of the pressure vessel. Thus, a minimum of downtime and other expense is expended in order to utilize the invention with respect to existing machines.

The paper industry is one of the largest industries with respect to consumption of energy in the world. A sizable portion of this energy is wasted from the heads of the drying sections of the papermaking equipment.

The mechanism of heat losses from the outside surface of the heads of the associated can rolls is a combination of radiation and various forms of convection. Radiative losses due to the surface emission of heat are about 10% of the total losses. Convection losses are best considered as comprising three components. The primary mode is the convection as a result of external air draft provided to aid in driving out the moisture from a web being dried. A secondary contribution to convection comes from the relative air movement generated by the rotation of the dryer roll head itself, which at moderate operating speeds has a similar magnitude of heat loss as from the radiative losses above. The final component is the natural free convection resulting from the temperature differential between the external surface of the head and the ambient air.

Typically, with a 60 inch diameter can roll operating at 1200 feet per minute using 300° F. steam, the radiative loss, natural convection loss, and convection due to rotation are of similar orders of magnitude and generally total less than about 30% of the total head heat loss. Heat loss from the shaft itself is generally less than about 7%. The balance of the heat loss, which is generally greater than two-thirds of the total loss from the heads, is from the forced convection due to air draft.

As is seen from FIG. 7, herein, the practice of this invention at today's energy cost, can commonly result in annual energy savings of up to $14,000 (dollars) per head, depending upon precise operating conditions. One papermaking machine may have more than twenty such can rolls.

The specific improvement of this invention provides a means of attachment of the insulating assembly to the head bolts. It includes bolting the panel assembly directly into the bolt heads of the head bolts by providing internally threaded bores in the bolt heads of the head bolts.

DESCRIPTION OF THE PRIOR ART

Various types of conventional dryer drums, or can rolls are illustrated in the following U.S. patents: U.S. Pat. No. 3,118,743 that issued to Malmstrom, et el, Jan. 21, 1964; U.S. Pat. No. 3,116,985 that issued to Kraus, Jan. 7, 1964; U.S. Pat. No. 3,217,426 that issued to Barnsheidt, et al, Nov. 16, 1965; U.S. Pat. No. 3,248,803 to Kirkorian that issued May 3, 1966; U.S. Pat. No. 3,911,595 that issued to Lande, Oct. 14, 1975; U.S. Pat. No. 2,374,745 that issued to Grimm May 1, 1945; U.S. Pat. No. 2,779,104 to Sims on Jan. 29, 1957; and U.S. Pat. No. 2,817,908 that issued to Hornbostel Dec. 31, 1957.

U.S. Pat. No. 1,076,330 that issued to Thompson Oct. 21, 1913, discloses radiative insulation means comprising the formation of a dead air space exterior of the head which is stated to be an improvement over the earlier method of covering the head with a layer of magnesia that could then be covered with a metal sheet. U.S. Pat. No. 1,640,855 that issued to Shlick Aug. 30, 1927, discloses means for covering head members with insulating material to reduce radiative losses and protect workers from the danger of becoming entangled with protruding bolts from the heads.

U.S. Pat. No. 4,241,518, to Alexy (issued Dec. 30, 1980), discloses a panel assembly attached to the head bolts with stud clamp means. Applicant copied claim 1 of the Alexy Patent in his pending application filed Dec. 30, 1981, Ser. No. 335,640 in order to provoke an interference proceeding. In any event, the Alexy patent does not disclose or teach the attachment means nor the combination disclosed and claimed in this application.

SUMMARY OF THE INVENTION

This invention, for which I desire to secure letters patent, is defined as being, in combination, a thermal insulation material end panel assembly for mounting on an axial end face of a heatable dryer cylinder, said dryer cylinder being capable of drying a web passing over the peripheral surface thereof, said dryer cylinder bearing a plurality of head bolts having bolt heads projecting axially from an end face thereof at spaced circumferential positions, said bolt heads having an internally threaded bore within a portion of the bolt head thickness with said bore being adapted to receive and mate with a protruding panel assembly bolt, and a plurality of protruding panel assembly bolts operatively associated with and affixed to said thermal insulation material end panel assembly at circumferential positions corresponding to said bolt heads and projecting therefrom, said protruding panel assembly bolts being mechanically screwed into the internally threaded bore of said bolt heads for removably locking said panel to the end of said dryer cylinder.

The invention also includes the above combination wherein said bolt heads of said head bolts have an elongated bolt head of sufficient thickness to contain said bore without bore penetration into the standard thickness of the bolt head.

It is preferred, generally, that said protruding panel assembly bolts are in substantial axial alignment with said head bolts and that the protruding panel assembly bolts pass through said end panel assembly.

BRIEF DESCRIPTION OF THE DRAWINGS

FIG. 4 is an end view of the modified can roll of FIG. 3, the shaft means being 16.

FIG. 5 is a broken away cross section of the modified head of FIG. 3.

FIG. 6 is a front view of an angle clip 22 useful for attaching the panel assembly to existing head bolts 19 as shown in FIG. 3.

Body bolt adapter 39 is affixed to the protruding head bolt 19 and attached to the head insulating member through external bolt 41.

Figure 13:
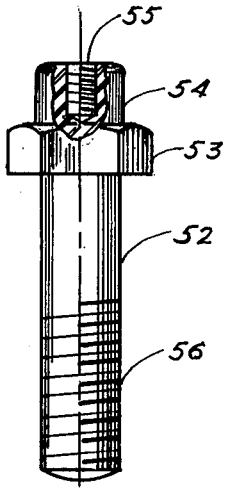

FIG. 13 is a vertical elevational view of a modified head bolt with a section of the thickened bolt head broken away to expose and illustrate an internal threaded bore, useful for attaching the panel assembly in accordance with this invention.

Figure 14:
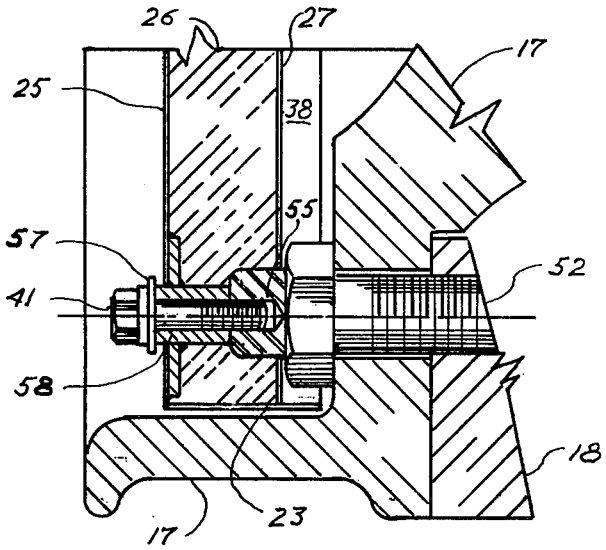

FIG. 14 is a cross-sectional view of an end portion of a conventional can roll with associated concave type head member 17 having the insulating panel assembly attached to the head with panel bolts threaded directly into the bolt heads of the head bolts—according to this invention.

DETAILED DESCRIPTION OF THE INVENTION

The invention is best described with reference to the figures of the drawings, wherein the same reference characters refer to the same parts throughout the figures.

A wet web to be dried 11, passes around can rolls 12, through guide or nip rolls 13, and out through discharge rolls 14 as a dried product in the form of a coherent web or sheet 15.

The shell 18 of the can roll has internal cavity 29 and exterior drying surface 20. Head 17 encloses the end of the cavity 29 and is bolted into the shell wall 18 with head bolts 19 that are spaced circumferentially around shell 18. Shaft means 16 is associated with head 17 to provide rotational means.

The head modifications to provide the improved highly thermally efficient head of this invention are illustrated in FIGS. 3, 4, 5, 6, 7, and 8. Angle clips 22 are affixed to head bolts 19 to provide means for retaining outer rim 23 in a sealing relationship with head 17. Head bolts 19 are received within space 33 of the angle clips 22 and portion 34 of the clip engages the outer rim 23 which is secured thereto by welding or other suitable fastening means. Portion 32 of the clip engages head 17.

Outer rim 23 has insulating material 26 of a low heat conductivity, such as ceramic fibers, held adjacent to its interior width portion.

The outboard end of outer rim 23 is enclosed with a number of parts comprising segmental heat insulating means comprising face plate 25 having two semicircular sections to enclose the outer rim 23 and receive shaft means 16 passing therethrough, and being held together with splice plate means 31 detachably affixed with bolts and associated "rivnuts" or other suitable means 30 to face plate 25. Face plate 25 is rigidly secured to outer rim 23 with clips 29 spaced around the rim 23. Sealing material 28, such as urethane rubber is affixed to face plate 25 to seal the shaft periphery and face plate 25.

Insulating material 26 is affixed adjacent to the inboard side of face plate 25, providing a dead air space 38 between the face plate 25 and its insulation 26, and the exterior of head 17.

Inner rim 24 is spaced from and rigidly attached to outer rim 23 with channel spacers 21 and the associated rivets or other suitable fastening means.

A second set of semicircular sheets 27 held together with splice plate means 31 and bolts 30 is arranged inboard of face plate 25 to provide a cavity for holding insulating material 26. The plates are spaced from each other with channel clips 29 and 21 and associated rivet or bolt means 29 and 37. Angle clip 35 and associated fastening means affixes inner rim 24 to back plate 27 to provide a rigid structure.

Body bolt adapter 39 is comprised of body member 42 and nut retainer means 47. The body member 42 is comprised of body member wall means 43, cap means 44 affixed atop wall means 43, which defines interior cavity 45 to receive the protruding body bolt 19 of the head member. Set screws 46, serve as grip means to detachably affix bolt 19 to the body bolt adapter 39. External bolt 41 from the insulator assembly is aligned with and mates with floating nut 40 that is held within nut retainer means 47. Bolt 41 passes through passageway 48 of nut retainer means 47.

Nut retainer means 47 is comprised of nut retainer wall means 49 with associated cap means 50 and associated bendable flange means 51 to allow for insertion of nut 40 into nut retainer means 47. The parts of the body bolt adapter can be separately cast and welded or cast as one piece.

Set screws 46, acting as grip means for holding rigidly the adapter 39 to the protruding body bolt 19, could be substituted with other types of biasing grip means, such as spring means or an expandable O-Ring—to name a few.

It is preferred that screw means such as a bolt and an associated "rivnut" be used at appropriate locations as the fastening means to facilitate removal of the face plate and back plate to provide easy access to the head for routine maintenance of the can roll.

Outer rim 23 typically has a width of about 7 inches and the inner rim about 5.5 inches, but these can vary to accommodate specific head designs. The thickness of the insulating material is typically about 1.5 inches.

The splice plates and rim support are preferably of stainless steel and the remainder of the parts of aluminum.

The energy savings resulting from the practice of this invention are evaluated on an internally steam heated 12 foot diameter can roll of a papermaking machine under various operating conditions. The insulation thickness is about 1.25 inches and comprised of a ceramic fiber blanket having a specific heat at 1800° F. mean of 0.255 Btu/lb./°F.

Figure 1:
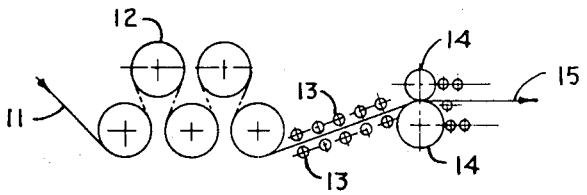
FIG. 1 is a diagramatic schematic illustration of a web processing machine dryer portion, showing an end view of heated can rolls 12.
Figure 2:
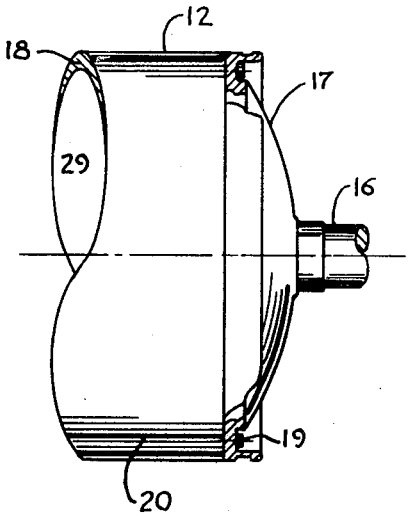
FIG. 2 is a side elevational view of an end portion of a conventional can roll showing its associated head member 17, partially broken away to show the interior of shell 29 and head bolt 19.
Figure 3:
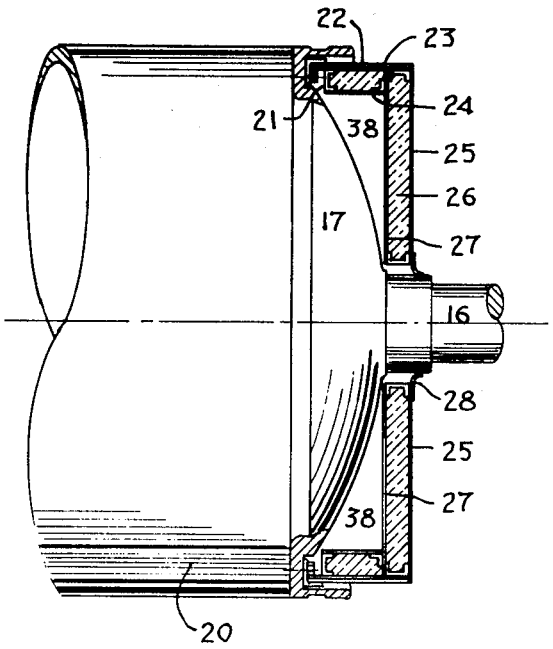
FIG. 3 is a similar view of the conventional can roll of FIG. 2 after having been modified with the addition of a panel assembly attached to head bolts 19 with clip means 22 under the head bolts.
Figure 7:
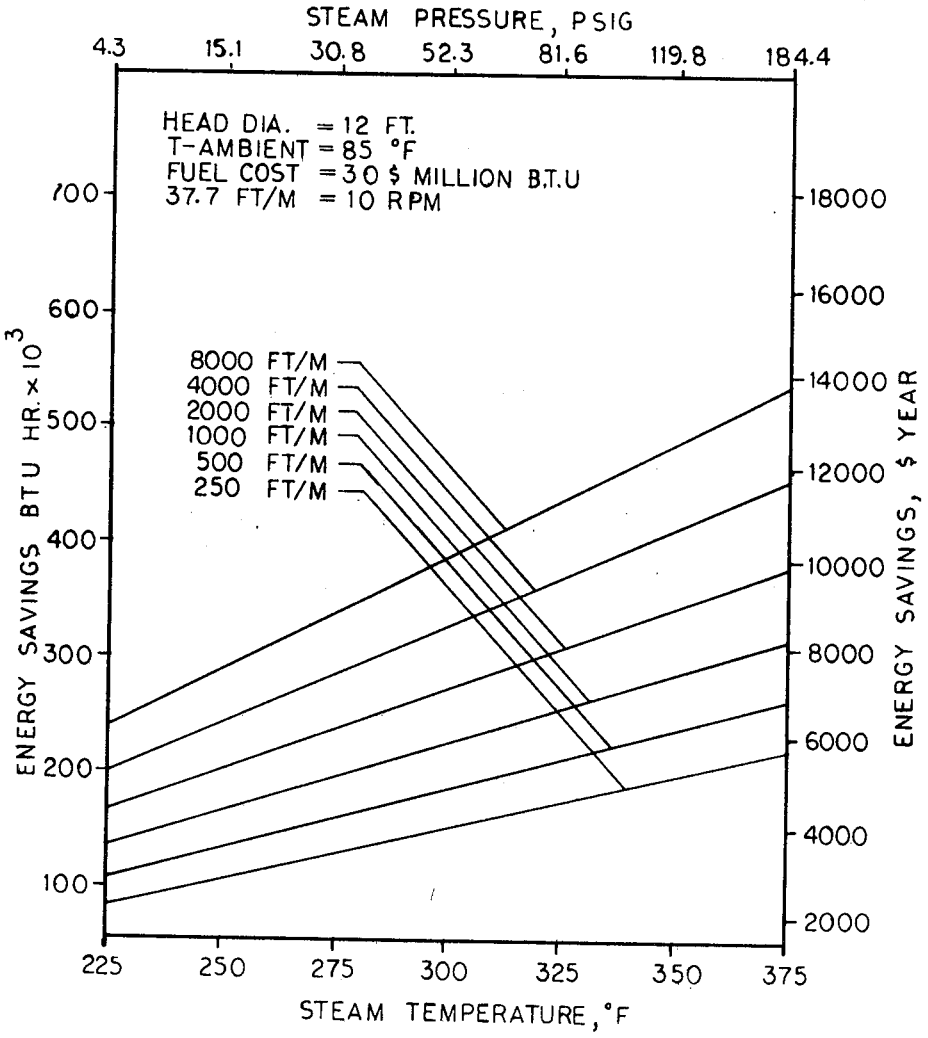
FIG. 7 is a graphical representation of a specific embodiment of this invention showing energy savings at various operating conditions for a 12 foot diameter can roll.
Figure 8:
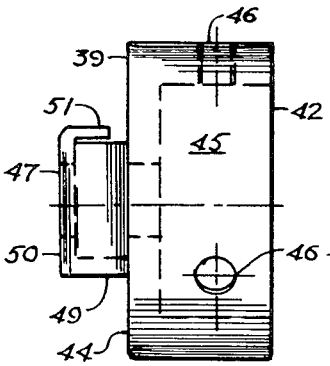
FIG. 8 is a side elevational view of the body bolt adapter useful for attachment of the panel assembly to the head members. The hidden interior surfaces are indicated with broken lines for greater clarity.
Figure 9:
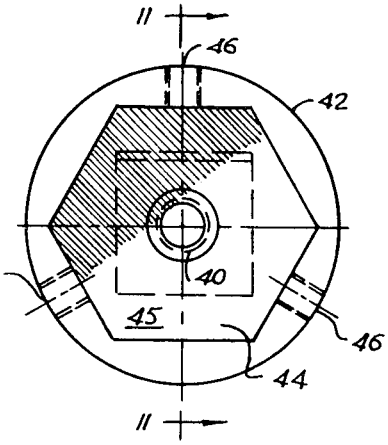
FIG. 9 is an end view of the body bolt adapter of FIG. 8, viewed from the end having interior cavity 45 for receiving the existing protruding body bolt from the head member. Hidden interior surfaces are indicated with broken lines.
Figure 10:
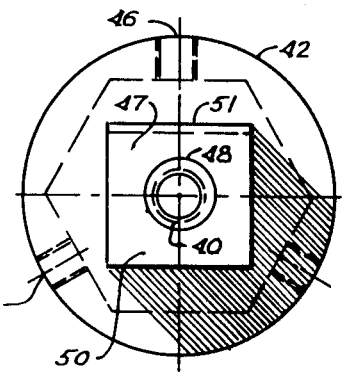
FIG. 10 is an end view of the body bolt adapter, viewed from the end having nut retainer means 47. The interior parts and surfaces are indicated with broken lines.
Figure 11:
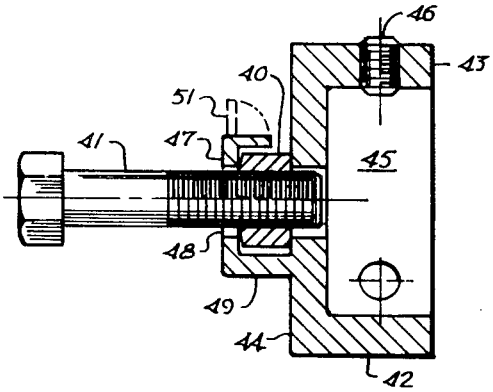
FIG. 11 is a cross-sectional view taken through line 11—11 of the body bolt adapter of FIG. 9.
Figure 12:
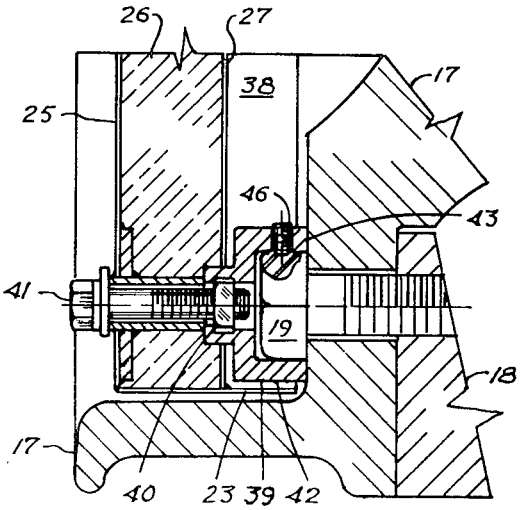
FIG. 12 is a cross-sectional view of an end portion of a conventional can roll with associated concave type head member 17 having the insulating panel assembly attached with the body bolt adapter.

The operating conditions and the resulting savings are set forth in FIG. 7.

A typical desirable insulating material is a ceramic fiber blanket sold by Babcock and Wilcox under the registered trademark "Kaowool."

The modifications resulting in the combination of this invention relate to means for attaching the insulating panel assembly to the head members and are depicted in FIGS. 13 and 14. The modified head bolt 52 has threaded portion 56, a standard bolt head thickness 53 and an extended thickness 54 containing threaded bore 55 that is adapted to receive and threadably mate with the external protruding panel assembly bolt 41. Bolt 41 has associated washer 57 and bushing spacer means 58. The holes through panel assembly face plates 25 and 27 for bolt 41 can be somewhat oversize to facilitate alignment of bolt 41 with threaded bore 55 as the washer 57 will seal the system.

For many applications, such as high speed can rolls wherein vibrations may be a problem, the attachment means of this invention are preferred over the bracket clip means or body bolt adapter means described herein.

What is claimed is:

1. In combination, a substantially rigid thermal insulation material end panel assembly for mounting on an axial end face of a heatable dryer cylinder, said dryer cylinder being capable of drying a web passing over the peripheral surface thereof, said dryer cylinder bearing a plurality of head bolts having bolt heads projecting axially from an end face thereof at spaced circumferential positions, said bolt heads having an internally threaded bore with said bore being adapted to receive and mate with a protruding panel assembly bolt, and a plurality of protruding panel assembly bolts operatively associated with and affixed to said thermal insulation material end panel assembly at circumferential positions corresponding to said bolt heads and projecting therefrom, said protruding panel assembly bolts being mechanically screwed into the internally threaded bore of said bolt heads for removably locking said panel to the end of said dryer cylinder, said bolt heads of said head bolts have an elongated bolt head of sufficient thickness to contain said bore without substantial bore penetration into a standard thickness of the bolt head.

2. The combination as defined in claim 1 wherein said protruding panel assembly bolts are in substantial axial alignment with said head bolts.

3. The combination as defined in claim 1 wherein said protruding panel assembly bolts pass through said end panel assembly.

* * * * *